US010228226B2

(12) United States Patent
Florian et al.

(10) Patent No.: US 10,228,226 B2
(45) Date of Patent: Mar. 12, 2019

(54) DEVICE FOR MONITORING AN IGNITION DEVICE

(71) Applicant: TDW Gesellschaft für verteidigungstechnische Wirksysteme mbH, Schrobenhausen (DE)

(72) Inventors: Johann Florian, Schrobenhausen (DE); Markus Graswald, Pfaffenhofen an der Ilm (DE); Raphael Gutser, Stadtbergen (DE)

(73) Assignee: TDW Gesellschaft für verteidigungstechnische Wirksysteme mbH, Schrobenhausen (DE)

( * ) Notice: Subject to any disclaimer, the term of this patent is extended or adjusted under 35 U.S.C. 154(b) by 0 days.

(21) Appl. No.: 15/239,432

(22) Filed: Aug. 17, 2016

(65) Prior Publication Data

US 2017/0184385 A1 Jun. 29, 2017

(30) Foreign Application Priority Data

Aug. 18, 2015 (DE) ..... 10 2015 010 855

(51) Int. Cl.
*F42C 15/40* (2006.01)
*F42C 19/08* (2006.01)
*F42C 19/095* (2006.01)

(52) U.S. Cl.
CPC ..... *F42C 15/40* (2013.01); *F42C 19/0842* (2013.01); *F42C 19/095* (2013.01)

(58) Field of Classification Search
CPC ..... F42C 14/40; F42C 14/36; F42C 14/34; F42C 19/0842; F42C 19/095
USPC ..... 102/202–202.9, 221, 222, 265
See application file for complete search history.

(56) References Cited

U.S. PATENT DOCUMENTS 3,717,098 A * 2/1973 Davis et al. ..... F42B 12/204 102/206
4,815,385 A 3/1989 Kingery et al.
6,269,746 B1 * 8/2001 Larsen ..... F42C 15/40 102/200

(Continued)

FOREIGN PATENT DOCUMENTS

DE 10 2012 006 044 B3 3/2013
DE 10 2014 004 003 B3 10/2014

(Continued)

*Primary Examiner* — John Cooper
(74) *Attorney, Agent, or Firm* — Jenkins, Wilson, Taylor & Hunt, P.A.

(57) ABSTRACT

A monitoring device and system are provided for monitoring normal sequence of an initiation. The device includes at least one sensor in a region of an explosive charge and/or in a region of at least one ignition device for the explosive charge of the munitions system, and also a control device for evaluating output signals of the sensor with the control device connected to at least one ignition device in a controlling manner on a basis of the evaluation. At least one sensor is arranged at an output of a first ignition device for subdetonative initiation of the explosive charge. The control device is connected to a further ignition device and enables or inhibits it on a basis of a signal supplied by the sensor and assessed in the control device, and at least one sensor is designed for sensing pressure, temperature, light, electrical current or changing of mechanical states.

18 Claims, 2 Drawing Sheets

(56) References Cited

U.S. PATENT DOCUMENTS

| | | | | |
|---|---|---|---|---|
| 7,891,297 | B1 * | 2/2011 | Rohr | F42B 12/02 102/265 |
| 8,931,415 | B2 * | 1/2015 | Volkmann | F42B 3/16 102/217 |
| 9,273,939 | B2 | 3/2016 | Ackermann | |
| 2010/0031841 | A1 * | 2/2010 | Michel | F42C 15/005 102/222 |
| 2012/0012019 | A1 * | 1/2012 | Harding | F42B 3/121 102/206 |
| 2012/0227609 | A1 * | 9/2012 | Volkmann | F42B 3/16 102/322 |
| 2015/0345915 | A1 * | 12/2015 | Ackermann | F42C 15/00 102/320 |

FOREIGN PATENT DOCUMENTS

| | | | |
|---|---|---|---|
| DE | 10 2013 011 404 | B4 | 3/2015 |
| EP | 2 789 965 | A1 | 10/2014 |
| EP | 2 824 414 | A1 | 1/2015 |

* cited by examiner

| Abbreviation | Description |
|---|---|
| ZK-A-U | Ignition chain A monitoring (watchdog) |
| ZS-ST | Ignition system control |
| HS-NT | High-voltage system part |
| ZS-A | Ignition system A (master) |
| ZS-B | Ignition system B (slave) |
| ZK-A | Ignition chain A (master) |
| ZK-B | Ignition chain B (slave) |
| EFI | Electronic Foil Initiator |

| | |
|---|---|
| → | High voltage |
| → | Energy supply |
| → | "Signal" |
| ⇒ | High current |
| ⇒ | Pyrotechnic effect |

DEVICE FOR MONITORING AN IGNITION DEVICE

CROSS-REFERENCE TO RELATED APPLICATION

This application claims priority to DE 10 2015 010 855.7 filed Aug. 18, 2015, the entire disclosure of which is incorporated by reference herein.

TECHNICAL FIELD

The disclosure herein relates to a device for monitoring the initiation of a munitions system, comprising at least one sensor in the region of the explosive charge and/or in the region of at least one ignition device for the explosive charge of the munitions system, and to a control device for evaluating the sensor output signals that is connected to at least one ignition device in a controlling manner on the basis of the evaluation.

BACKGROUND

For flexible control of the power delivery, there have already been proposals for scalable munitions system concepts, the compact ignition system of which combines two ignition circuits and two pyrotechnic outputs, which may be linked with a timing control. Consequently, various active modes can be realized, from controlled deflagration as the minimum effect through time-delayed, combined reaction mechanisms as intermediate effects to classic detonation with the maximum effect. This spatial combination of deflagrator and detonator in a compact ignition system provides numerous practical and operational advantages.

There are already known sensors that can sense and evaluate the progression of a deflagration front in the explosive charge of such a munitions system. DE 10 2012 006 044 B3 describes such a method and a device suitable for it, with the aid of which, after the initiation of a deflagration of the explosive charge, the ignition time of a further ignition chain can also be determined.

Use of such a munitions system means that the ignition system has to meet specific requirements in order to ensure with high functional reliability when choosing a subdetonative mode of action that at least the explosive charge does not undergo a stronger reaction than that chosen. This is the case for example if the deflagrator ignition circuit fails or, for other reasons, the initiation of the deflagration reaction does not take place and the time-delayed detonator ignition circuit initiates the detonative reaction of the explosive charge. This would then lead to the maximum power delivery, or at least to a greater power delivery than is intended. This would have the consequence that some troops in the vicinity would be put at risk or there would be unintentional collateral damage to noncombatants or buildings.

Less critical here are cases in which the detonator ignition circuit fails, which has a minimal effect, or if both ignition circuits fail. While the first case is likely to be acceptable from an operational viewpoint, the latter case results in an explosive charge that is left unexploded. In order to minimize the probability of such an event occurring, allowance has been made for this in the past by the design of the ignition system and appropriate choice of components. Moreover, in principle this should be preferred in practice, rather than a higher power delivery than intended.

SUMMARY

The present disclosure is therefore based on an object of increasing the functional reliability of the ignition system after failure of a subdetonative reaction, such as for example a deflagration, to occur in comparison with that previously known with the aid of suitable measures.

This object is achieved at least in part or in whole according to the disclosure herein by at least one sensor being arranged at the output of a first ignition device for the subdetonative initiation of the explosive charge, by the control device being connected to a further ignition device and enabling or inhibiting the latter on the basis of the signal supplied by the sensor and assessed in the control device, and by at least one sensor being designed for sensing pressure, temperature, light, electrical current or the changing of mechanical states.

Further embodiments of the device according to the disclosure herein are described in the further dependent claims.

The advantages of the proposal are that the functional reliability of the ignition system can be influenced both by way of circuitry and also by suitable selection of the electrical components and the one-shot devices such as detonators and EFIs (Exploding Foil Initiators). In the case of a compact ignition system with two ignition circuits, this gives rise to further measures for suppressing the triggering of the detonator in the event of failure of the deflagrator, and consequently failure of the deflagration initiation, to occur. Apart from the failure of the deflagration of the munitions charge to occur, premature detonation could also lead to delivery of a stronger output power. However, the measures that are described below are concentrated primarily on the first case.

Measures that may contribute to this are those such as the switching of the minimum mode as a standard setting after arming of the ignition system, a redundant design of the deflagrator with high-voltage ignition circuits and pyrotechnic outputs or else a spatial separation of the high-voltage ignition circuits of the deflagrator and the detonator.

It is also presupposed that suitable measures are taken to prevent a sympathetic initiation and/or electrical triggering between the deflagrator and the detonator. This may take place by the design of the ignition system and suitable selection of the material for corresponding barriers for shock absorption. The risk of electrical crosstalk can be reduced in terms of circuitry by isolation of the electrical energy supply and by ground connections and also isolators such as optocouplers between the low-voltage part and the high-voltage part of the ignition system.

On the other hand, a sensor which detects the pyrotechnic event of the deflagrative reaction of the explosive charge on the basis of suitable physical variables may lead to a further improvement in the reliability of the ignition system and the munitions part. By linking the sensor with the control unit of the ignition system, in which there is also the time control logic for the modes of action, the detonator is only enabled and triggered after positive detection of the deflagration event.

Pressure, temperature, optical or electrical sensors or sensors that detect the change in mechanical states may be used as the measuring device. These sensors may also be combined with a venting channel for pressure relief after initiation of the subdetonative reaction.

The measuring device can be advantageously combined with the sensors in such a way that the high-voltage circuit for the detonator is only armed and supplied with voltage once the deflagration event has been positively sensed. The high-voltage ignition circuits for the deflagrator and the detonator may also be interconnected with the high-voltage converter in a master-slave arrangement.

Such measures finally allow the functional reliability to be increased in order to prevent a higher power delivery of the munitions system than originally chosen or intended. They also offer the advantage that they can be performed either directly in or in the vicinity of the ignition system.

BRIEF DESCRIPTION OF THE DRAWINGS

An exemplary embodiment of the disclosure herein is presented in the figures of the drawing and is described in more detail below. In the drawing.

DETAILED DESCRIPTION

Figure 1:
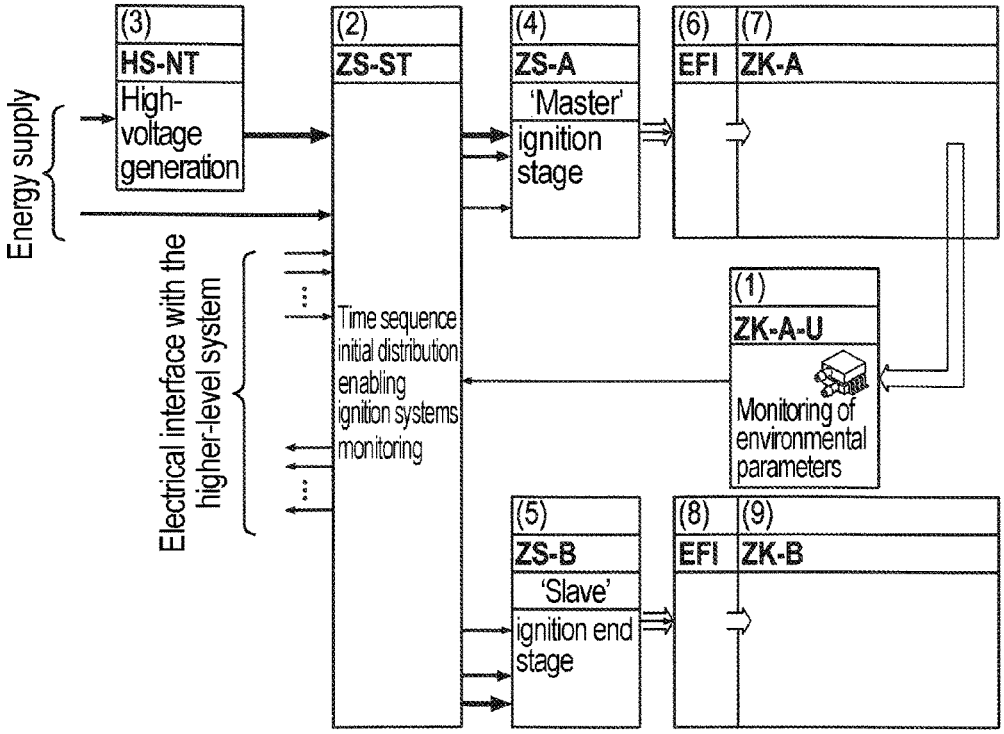
FIG. 1 shows a block diagram of a device according to the disclosure herein.

In FIG. 1, a block diagram of the device according to the disclosure herein is represented in a schematically simplified form. A high-voltage system part HS-NT supplies not only the control device ZS-ST for the ignition system, but also both ignition systems ZS-A and ZS-B, the EFIs EFI and the ignition chains ZK-A and ZK-B.

The control device ZS-ST performs various tasks in the sense of safe ignition triggering or reducing the risks in the event of a malfunction in the subdetonative initiation of the explosive charge.

On the one hand, the time-controlled distribution of electrical energy in the form of low voltage and high voltage for supplying the subassemblies is carried out here. On the other hand, control signals are sent from here to all of the subassemblies involved and the responses received from them are evaluated.

In the control device ZS-ST, the output signal of the sensor ZK-A-U that monitors the function of the first ignition chain ZK-A is evaluated. Only when the satisfactory function of this ignition chain is confirmed does the control device generate an enabling signal for the further ignition system ZS-B and the further ignition chain ZK-B. If one of the subassemblies fails with a malfunction, the detonative initiation of the explosive charge is consequently prevented.

Figure 2:
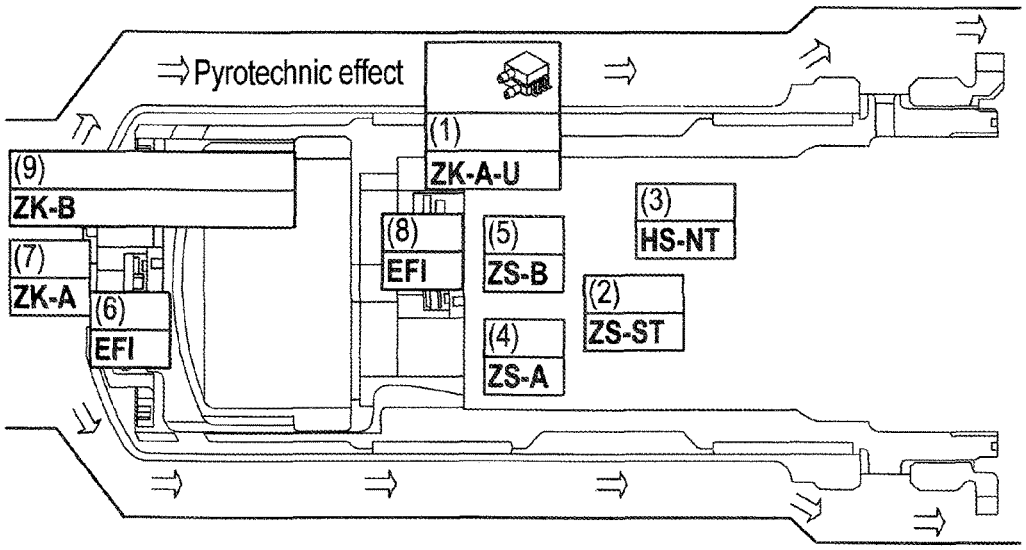
FIG. 2 shows a possible arrangement of the subassemblies in the region of the ignition devices.

The diagram in FIG. 2 represents in a greatly simplified form the locational position of the subassemblies in one possible embodiment of an ignition system according to the disclosure herein. In the central region of the approximately cylindrical overall arrangement are the already mentioned subassemblies of the ignition devices. The power supply HS-NT can be seen on the right; alongside is the control device ZS-ST. Further to the left, following one after the other, are the various intensity stages of the two ignition chains. On the far left, the explosive charge would be placed, but is not shown.

To relieve the pressure during the initiation, arranged around the centrally arranged subassemblies are venting channels, which on the right-hand side discharge into the open environment. Placed there by way of example was the sensor ZS-A-U which detects the proper functioning of the ignition chain ZK-A and reports this to the control unit ZS-ST. Only then are the second ignition system ZS-B and the associated ignition chain ZK-B enabled.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF DESIGNATIONS

| Designation | Description |
|---|---|
| ZK-A-U | Monitoring of the first ignition chain (watchdog) |
| ZS-ST | Control device of ignition system |
| HS-NT | High-voltage system part |
| ZS-A | First ignition system (master) |
| ZS-B | Further ignition system (slave) |
| ZK-A | First ignition chain (master) |
| ZK-B | Further ignition chain (slave) |
| EFI | Exploding Foil Initiator |

The invention claimed is:

1. A device for monitoring initiation of a munitions system, the device comprising:

at least one sensor in a region of a first ignition device for an explosive charge of the munitions system, and a control device for evaluating output signals of the at least one sensor, the control device being connected to the first ignition device in a controlling manner based on an evaluation by the control device, wherein the at least one sensor is arranged at an output of the first ignition device for subdetonative initiation of the explosive charge, wherein the control device is connected to a second ignition device and is configured to enable or to inhibit the second ignition device based on a signal supplied by the at least one sensor evaluated in the control device, wherein the at least one sensor is designed for sensing pressure, temperature, light, electrical current, or a changing of mechanical states, wherein the at least one sensor is arranged in, or in a vicinity of, a venting channel, wherein the venting channel is arranged between the first ignition device for the subdetonative initiation into an open environment to provide pressure relief, and wherein the at least one sensor is configured to detect physical effects of the subdetonative initiation.

2. The device of claim 1, wherein the control device acts on ignition circuits for the subdetonative initiation and detonative initiation.

3. The device of claim 1, wherein the at least one sensor is configured to detect environmental conditions, and wherein the inhibiting or enabling signal can be corrected based on the environmental conditions detected.

4. The device of claim 1, wherein a high-voltage circuit for the second ignition device is only armed and supplied with voltage and/or enabled for ignition after sensing that the subdetonative initiation has commenced via the at least one sensor.

5. The device of claim 1, wherein detection of subdetonative initiation is selectable for the control device as a basic setting or an ignition circuit can always be chosen first for the subdetonative initiation irrespective of a selected mode of action of the munitions system.

6. The device of claim 1, wherein the control device is connected to at least two high-voltage ignition circuits and/or at least two ignition devices are present.

7. The device of claim 1, wherein the control device is connected to a high-voltage ignition circuit for the first ignition device for initiation of the subdetonative initiation and then, in a master-slave arrangement, a high-voltage ignition circuit for the second ignition device is subsequently switched for a detonative initiation.

8. The device of claim 1, wherein a shock absorbing barrier is arranged between the first ignition device and the second ignition device.

9. The device of claim 1, wherein the at least one sensor comprises a temperature probe.

10. A device for monitoring initiation of a munitions system, the device comprising:

at least one sensor in a region of a first ignition device for an explosive charge of the munitions system, and a control device for evaluating output signals of the at least one sensor, the control device being connected to the first ignition device in a controlling manner based on an evaluation of an output of the at least one sensor by the control device, wherein the at least one sensor is arranged at an output of the first ignition device for subdetonative initiation of the explosive charge, wherein the control device is connected to a second ignition device and is configured to enable or to inhibit the second ignition device based on a signal supplied by the at least one sensor evaluated in the control device, wherein the at least one sensor is designed for sensing pressure, temperature, light, electrical current, or a changing of mechanical states, and wherein the at least one sensor is configured to detect physical effects of subdetonative initiation of the explosive charge.

11. The device of claim 10, wherein the control device acts on ignition circuits for the subdetonative initiation and detonative initiation.

12. The device of claim 10, wherein the at least one sensor is configured to detect environmental conditions, and wherein the inhibiting or enabling signal can be corrected based on the environmental conditions detected.

13. The device of claim 10, wherein a high-voltage circuit for the second ignition device is only armed and supplied with voltage and/or enabled for ignition after sensing that the subdetonative initiation has commenced via the at least one sensor.

14. The device of claim 10, wherein detection of subdetonative initiation is selectable for the control device as a basic setting or an ignition circuit can always be chosen first for the subdetonative initiation irrespective of a selected mode of action of the munitions system.

15. The device of claim 10, wherein the control device is connected to at least two high-voltage ignition circuits and/or at least two ignition devices are present.

16. The device of claim 10, wherein the control device is connected to a high-voltage ignition circuit for the first ignition device for initiation of the subdetonative initiation and then, in a master-slave arrangement, a high-voltage ignition circuit for the second ignition device is subsequently switched for a detonative initiation.

17. The device of claim 10, wherein a shock absorbing barrier is between the first ignition device and the second ignition device.

18. The device of claim 10, wherein the at least one sensor comprises a temperature probe.

* * * * *